US006231423B1

(12) United States Patent
Deal et al.

(10) Patent No.: US 6,231,423 B1
(45) Date of Patent: May 15, 2001

(54) MALLEABLE BRA PAD

(75) Inventors: Ann Deal; Kathleen Nadsady; Robert Jiminez, all of Ventura, CA (US)

(73) Assignee: Ce Soir Lingerie Co., Inc., Ventura, CA (US)

( * ) Notice: Subject to any disclaimer, the term of this patent is extended or adjusted under 35 U.S.C. 154(b) by 0 days.

(21) Appl. No.: 09/392,399

(22) Filed: Sep. 9, 1999

Related U.S. Application Data

(63) Continuation-in-part of application No. PCT/US99/02700, filed on Feb. 9, 1999.

(51) Int. Cl.[7] ..... A41C 3/10
(52) U.S. Cl. ..... 450/57; 450/38
(58) Field of Search ..... 450/57, 38, 30–35, 450/53; 623/7, 8; 607/104–108

(56) References Cited

U.S. PATENT DOCUMENTS 3,845,507 * 11/1974 Kirby et al. ..... 623/7
5,098,330 * 3/1992 Greenberg ..... 450/55
5,334,082 * 8/1994 Barker ..... 450/31
5,370,688 * 12/1994 Schulz et al. ..... 623/7
5,411,554 * 5/1995 Scopelianos et al. ..... 623/8
5,902,335 * 5/1999 Snyder, Jr. ..... 623/7
6,015,332 * 1/2000 Lee et al. ..... 450/57

* cited by examiner

*Primary Examiner*—Gloria M. Hale
(74) *Attorney, Agent, or Firm*—Marvin E. Jacobs

(57) ABSTRACT

A push-up bra has an envelope between the front panel and the rear panel of the bra cups, that receives a flexible pouch containing a body of lubricous, malleable material such as lightly cross-linked organo-polysiloxanes containing a dispersion of lightweight, finely-divided filler such as silica. The malleable material can be molded into a shape under and/or to either side of a breast to control the shape, amount of lift and the cleft between breasts and the lubricity of the siloxane resin prevents the filler from abrading the inner wall of the pouch.

16 Claims, 3 Drawing Sheets

MALLEABLE BRA PAD

CROSS-REFERENCE TO RELATED APPLICATION

This application is a continuation-in-part of International Application Serial No: PCT/US99/02700 filed Feb. 9, 1999.

TECHNICAL FIELD

The present invention relates to an improved pad for a brassiere and, more particularly to a pad comprising a flexible envelope containing a body of malleable material that can be incorporated into a push-up bra or into a pad for placement in a conventional bra.

BACKGROUND OF THE INVENTION

Brassieres are worn not only to provide support for women's breasts, but also to enhance the shape of the breasts within the brassieres, to enhance the shape of the portion and amount of the breasts above the brassieres and to modify the cleavage between the breasts.

Push-up bras are designed to shape and elevate the breasts. Push-up bras usually contain a rubber pad received in a pocket in the lower front panels of the bra cups. The pad is formed by molding into a complex arcuate shape. Rubber pads are both stiff and uncomfortable and do not exhibit the natural feel of breast tissue. Rubber pads also cause insecurity due to straying of the pads. Other push-up bras used a more yielding silicone foam and some use Nylon (polyamide) padding to shape and lift.

Push-up bras with liquid filled envelopes have recently appeared on the market. These pads more clearly emulate the consistency of breast tissue. However, the liquids used to fill the envelopes are not satisfactory. Silicone oil liquids are very expensive and are hard to seal. Hydrocarbon oils have also been utilized as the liquid either alone or in a mixture with water. Hydrocarbons can attack the envelope. The liquids in the envelope are heated to body temperature of about 99° F. At this temperature, evaporation is increased and the hydrocarbon vapors can permeate through the wall of the envelope, creating offensive, unpleasant odors. Furthermore, water vapor is also able to permeate through the wall of the envelope decreasing the liquid volume in the envelope. The envelope could rupture on impact or when pierced by a sharp object causing embarrassment, discomfort and destruction of the pad.

List of References

| Patentee | U.S. Pat. No. |
|---|---|
| Block, et al. | 3,620,222 |
| Kirby, et al. | 3,845,507 |
| Lynch | 3,986,123 |
| Miller | 5,235,974 |

STATEMENT OF THE PRIOR ART

Block, et al. discloses a foam, push-up brassiere pad. Kirby, et al. discloses a breast prosthesis to be worn inside a brassiere cup containing an inner bag. A gel-like liquid such as carboxymethyl cellulose is sealed within an outer bag containing air. Miller discloses an electrically heated bra for lactating mothers containing a fluid impermeable chamber filled with water. Lynch discloses a breast prosthesis filled with a low density silicone gel. The gel used by Lynch is not malleable.

The improved push-up pad described in copending application Ser. No. 09/132,572, filed Aug. 11, 1998, the disclosure of which is expressly incorporated herein by reference, contains a flexible envelope filled with a mixture of water and an odorless, organic hygroscopic agent in specified proportions providing no unpleasant aroma and little evaporation of water through the film of the envelope. The envelope is formed of a film of a tough synthetic resin resistant to puncture, preferably a thermoplastic resin capable of being heat-sealed. The film has low transmission rate for water vapor. The hygroscopic agent is able to drive water vapor from outside the envelope through the film into the envelope so that liquid volume is maintained.

This push-up bra looks and feels more natural and the bra eliminates discomfort and insecurity caused by stiff, sharp edged or straying inner pads. The inner cup lining adjacent the skin is soft and wicks moisture away from the skin.

However, though the push-up pad does not stray, the liquid in the pad, will distribute throughout the envelope depending on the compression forces applied to the envelope during wearing the bra. Even if a portion of the pad is positioned on the sides of a cup, most of the liquid will tend to position at the bottom of the cup.

In an earlier experiment, a body of malleable material was synthesized from water thickened with a small amount usually about 0.5% by weight of a polyacrylamide thickener and containing about 20% by weight of a filler such as silica microspheres. The material was malleable. However, when placed in a thin film pouch for use in a bra pad, the forces of the filler against the inner wall of the film abraded the film of the bag until it failed.

STATEMENT OF THE INVENTION

In the present invention, a push-up bra pad contains a lubricous body of malleable material. The pad can be placed in any position, under or to the sides of the breast and molded into a desired shape. The malleable material will retain the desired shape during normal usage. The malleability of the material is similar to natural tissue. Unlike a prosthesis which has a volume and shape equal to a breast, the push-up pad of the invention has a volume less than that of a breast, usually from 10% to 40% of the volume of a bra cup.

The malleable material has no elastic memory. It does not flow unless placed under pressure. The desired properties can be provided by forming a partially cross-linked, self-lubricating polymer material. Suitably, cross-linking less then 10% of the material is sufficient to form a 3-dimensional matrix when cross-linked. The amount of cross-linking is controlled by presence of cross-linkable groups such as unsaturated groups, suitably vinyl groups. The curing reaction can be accelerated by the presence of a curing catalyst. The size of the molecules of cross-linked polymer material is too large to permeate through the wall of the pouch containing a body of the material.

The push-up pad adds additional weight to be carried by the wearer of the bra. The weight of the pad can be reduced and strength increased by dispersing a reinforcing filler in the matrix of the material. The reinforcing filler also contributes to the desired malleability. Suitable materials are finely divided minerals such as fumed silica or glass or polymeric microspheres suitably having a diameter from 10 to 500 microns and present in an amount from 3–40%, suitably from 10–30% by weight of the material. As the polymer material cross-links the particles of filler are immobilized within the cross-linked matrix.

The pads of the invention can also be used in outerwear such as bathing suit tops and athletic tops.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
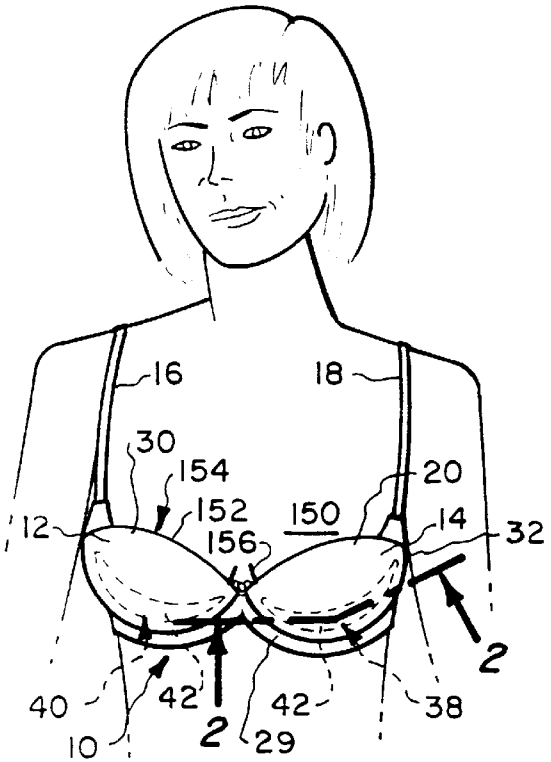
FIG. 1 is front view in elevation illustrating the push-up bra of the invention with the malleable material in a lower central position in a cup.
Figure 2:
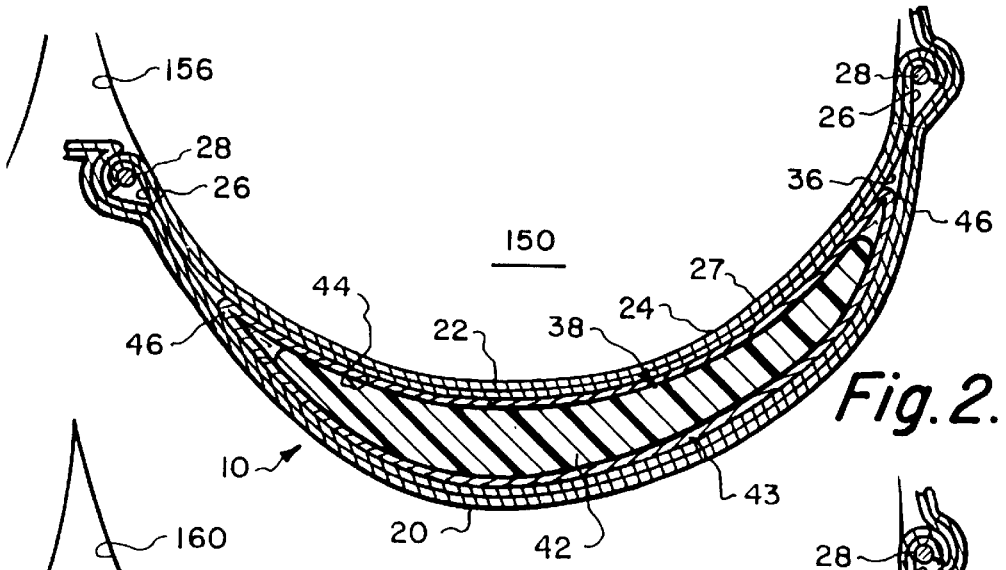
FIG. 2 is a view in section taken along line 2—2 of FIG. 1.

Referring now to FIGS. 1 and 2, a push-up bra 10 useful with the malleable material pouch 38 of the invention is formed of two cups 12, 14, a stretchable strap, not shown, connected to the outside periphery of each cup 12, 14 with releasable fastener, not shown, and optional shoulder straps 16, 18.

The cups 12, 14 are formed of an outer layer 20 of fabric and an inner layer 22 of fabric. The outer layer 20 of fabric can be covered with a layer of decorative material such as lace. The surface 24 of the inner layer 22 is preferably covered with a layer of a soft material 27 which absorbs and wicks moisture such as woven cotton or polypropylene cloth. A long narrow sleeve 26 following the curved outline of the bra cup can be formed along the lower periphery 29 of the bra cups 12, 14. A curved metal stiffening rod 28 can be received in the sleeve 26.

The outer layers 20 are stitched around their common peripheries 30, 32 to form pockets 34, 36 for receiving flexible pouches 38, 40 containing a body 42 of malleable material as shown in FIG. 2. The pouches 38, 40 can have the general exterior shape of a bra cup 12, 14. The pouches 38, 40 are formed of a front film 43 heat sealed at their common perimeters to a rear panel 44 forming a lip 46. The pouches 38, 40 are preferably anchored to the outer layer 20 or inner layer 22 of fabric. The lip 46 could be formed by adhering the outer peripheries of the two panels by adhesive or stitching. However, stitching or adhesive could make the lip 46 more susceptible to tear. It is preferred that the pouches 38, 40 be provided with an extended tab, not shown, which before thermal bonding serves as a filling spout. The two layers 20, 22 of the pouch are completely thermal sealed within the tab into a unitary film. Two thermally generated beads, not shown, can be provided normal to the axis of the pouches to reinforce the tab from tearing.

The tab can be sewn into the edge of the outer layer of fabric 20 near the outside periphery of the pockets 34, 36. The pouches 38, 40 are then inserted into the pockets 34, 36. The edge of the inner layer 22 of fabric is then stitched to the edge of the outer layer 20.

The skin of the pouch is a tough, puncture-resistant, leak resistant, flexible film such as a 0.01 to 5 mm thick film, preferably a film having a thickness from 0.05 to 0.5 mm. Suitable films are thermoplastic, thermally bondable films such as polyethylene, vinyl, silicone resins or polyurethane which can be in the form of a closed cell foam. The surface of the pouch has good wetability for water, is resistant to hydrolysis, has flame retardence and resistance to U.V. radiation. It is stable to being agitated with hot soapy water in a washing machine. The film can have a Shore A Hardness from 50 to 100, a Specific Gravity of 1.1 to 1.3, an elongation of at least 300% and a minimum tear strength of 200 Lb/in. The film should have a high melting temperature above 180° C. in order to be capable of surviving temperatures encountered in washing and drying machines. However, hand washing and air drying of the bra are preferred.

The malleable material which is placed in the pouches is preferably odorless and stable to the heat and forces encountered during use. A preferred material is a lightly cross-linked organo-polysiloxane optionally reinforced with finely divided silica or microspheres of glass or epoxy resin. The cross-linking can be provided by unsaturated sites on the starting materials. The malleable material is preferably made from two cross-linkable liquids which can be of polymeric length which are mixed together and reacted to form the cross-linked material. The reinforcing agent is dispersed in one or both of the starting liquids. Catalyst is added, such as an addition polymerization, platinum metal and the mixed material reacted to form a cross-linked, malleable material similar to a viscous paste.

Organo-polysiloxanes are preferred because of their known biocompatibility with human tissue and excellent lubricating properties. Cross-linking is provided by adding at least one vinyl group to the starting dialkyl alkyl silicone materials. The major portion of the malleable material can be formed of a dialkyl alkyl vinyl siloxane in which each alkyl group contains 1–6 carbon atoms. A minor portion of the material can be an alkyl vinyl, dialkyl alkyl hydrogen siloxane where the alkyl groups contain 1–6 carbon atoms.

An example of practice follows:

Part A 100 parts by weight 50% Dimethyl and 50% Methyl vinyl siloxane liquid copolymer Part B 0.1 parts by weight 50% Methyl vinyl and 50% dimethyl methyl hydrogen siloxanes liquid copolymer The mixture of A and B contains 20% by weight of silica microspheres.

Physical Properties—Part A

Boiling point: >260° C.

Specific Gravity (water=1): 0.7

Vapor Pressure at 25° C.: >1 mm Hg—essentially non-volatile

Vapor Density (air=1): N/A—essentially non-volatile

Water Solubility: nil

Evaporation Rate (Ethyl Ether=1): nil

Appearance and Odor: Colorless, translucent, viscous, paste

Physical Properties—Part B

Boiling point: >260° C.

Specific Gravity (water=1): 0.9

Vapor Pressure at 25° C.: negligible—essentially non-volatile

Vapor Density (air=1): N/A—essentially non-volatile

Water Solubility: nil

Evaporation Rate (Ethyl Ether=1): N/A

Appearance and Odor: Colorless, translucent, fluid

Parts A and B were mixed with platinum catalyst and cross-linked to form a malleable matrix material.

A prototype of the push-up bra of the invention was prepared by filling an elastomeric polyurethane pouch.

The pouch was formed from a closed cell polyurethane film having the following properties:

| Properties | |
|---|---|
| Color APHA | 5 |
| Thickness | 0.1 mm |
| Hardness | 87 Shore A |
| Specific Gravity | 1.20 |
| Tensile Strength | 6525 psi |
| Elongation | 480% |
| Tear Strength | 400 lb/in |
| Melting Temperature | 180–190° C. |

Figure 7:
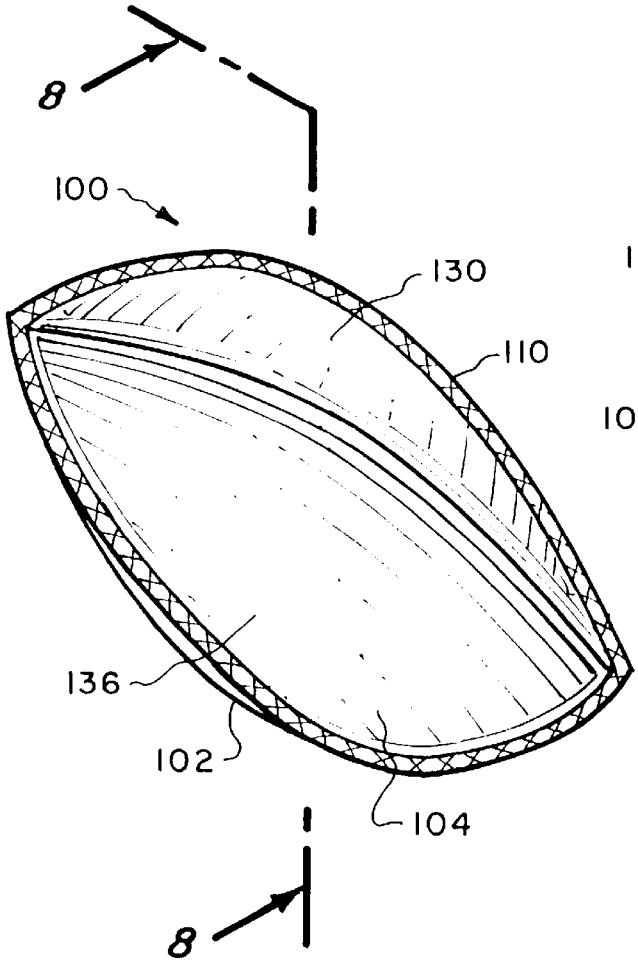
FIG. 7 is a perspective view of a malleable bra pad according to the invention.
Figure 8:
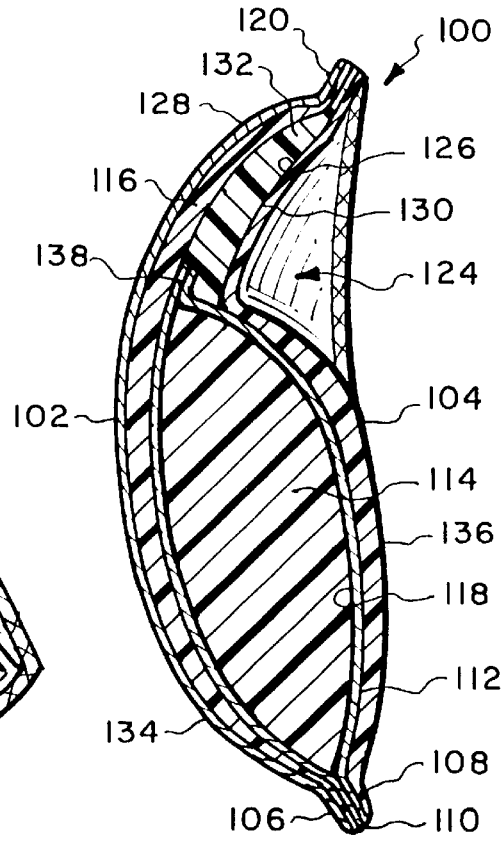
FIG. 8 is a view in section taken along line 8—8 of FIG. 7.

The malleable material containing pouch of the invention can also be incorporated into an uplift bra pad 100 as shown in FIGS. 7–8. The pad 100 has an oval-shaped front panel 102 and an oval shaped rear panel 104. The panels can be formed of woven or non-woven fabrics, preferably a soft woven synthetic fabric such as Nylon (linear polyamide) or polyester. The peripheral edges 106, 108 of the panels 102, 104 are joined, suitably by stitching 110 to form a cavity 118 for receiving a pouch 112 containing a body 114 of malleable material.

The panels may have a thin layer of flexible foam usually 1/16 to 1/4 inch thick attached to the inside surface, suitably by adhesive and/or thermal lamination. An optional strip 116 of flexible foam my extend across the upper portion of the cavity 118. The strip 116 is usually from 1/4 to 1/2 inch thick and occupies no more than 45% of the height of a cavity 118 usually about 30–40% of the cavity. The lower edge 120 of the strip 116 can be bound by stitching to the peripheral edges of the pad 100.

Another optional feature is to laminate the front panel 102, rear panel 104 and flexible foam strip 116 together by heat or adhesive to form a closed, flat upper portion 124 decreasing the size of the cavity 118 to form a smaller cavity 126. The upper portion 124 will have a convex front face 128 and a concave rear face 130. When the pouch 132 is inserted into the cavity 126 the lower portion 134 of the front face and lower portion 136 of the rear face will both have a convex shape. The pouch 112 has a tab 138 which can be placed between the outer edges of the panels 102, 104 and sewn to anchor the pouch 132 within the smaller cavity 126.

Figure 3:
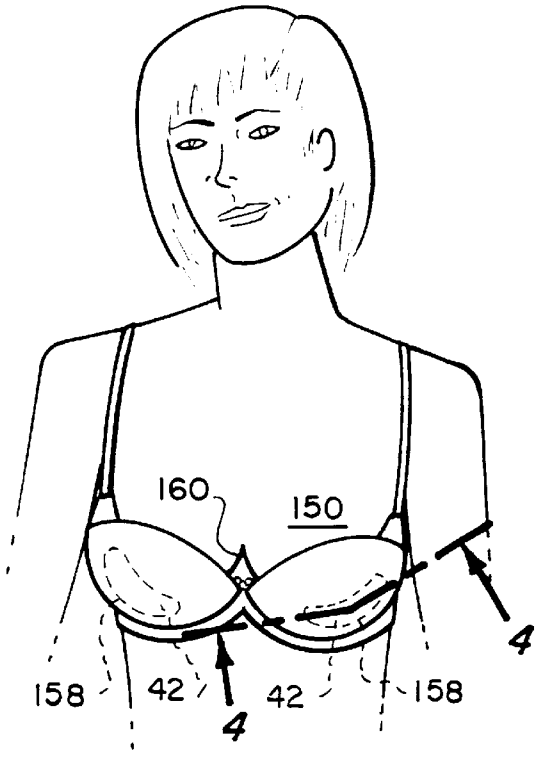
FIG. 3 is a front view in elevation of a bra with the malleable material molded to the outside of the cup.
Figure 4:
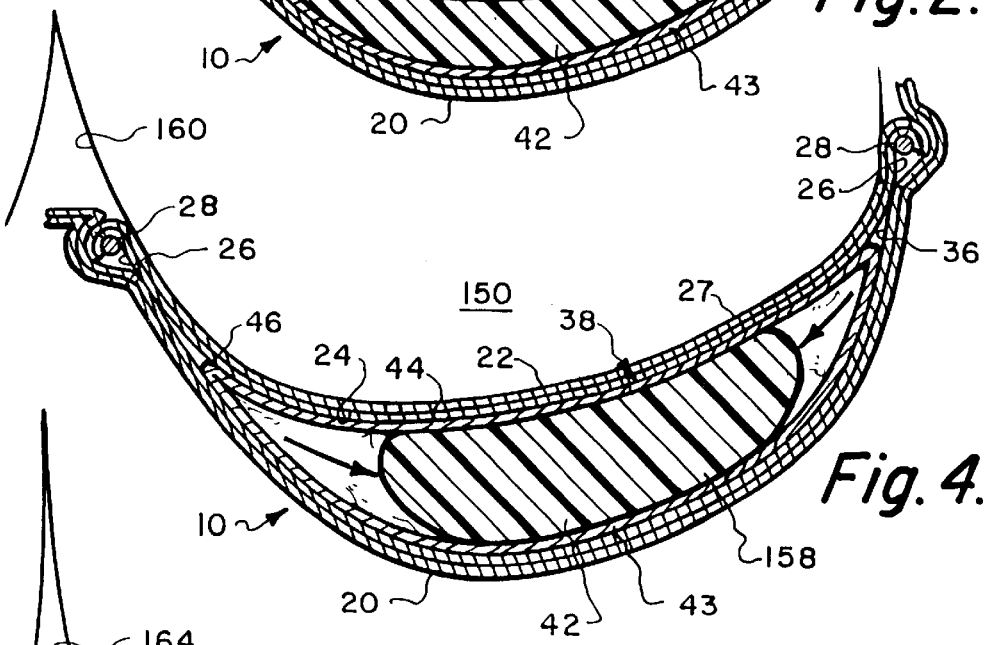
FIG. 4 is a view in section of a bra pad taken along line 4—4 of FIG. 3.

Referring again to FIGS. 1 and 2, the pads 100 contain pouches 38, 40 filled with a body 42 of malleable material. The body 42 of malleable material shown in dotted lines, can be formed into a crescent shape and centrally positioned under a breast 150. The breast 150 will be uniformly lifted above the top edge 152 of the bra 154 to form a first cleavage 156. As shown in FIGS. 3–4, when the body of malleable material 42 is molded into a thicker, shorter body 158, placed toward the outside of each breast 150, the breasts will be lifted up and pressed closer together to form a second longer cleavage 160.

Figure 5:
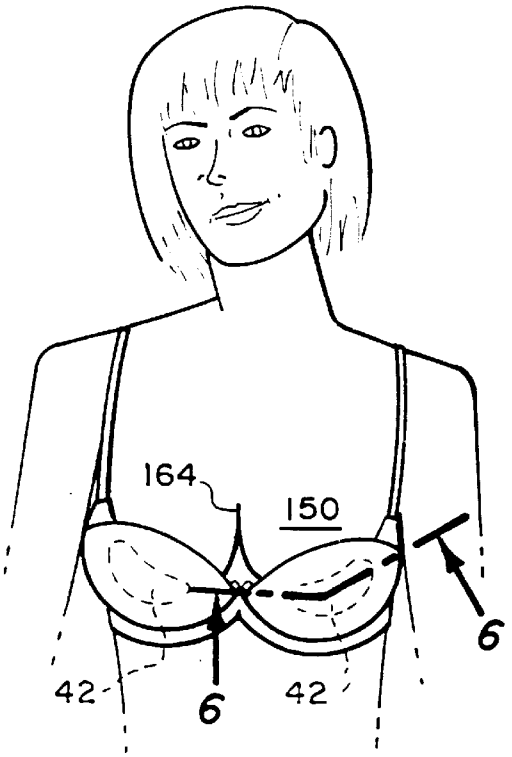
FIG. 5 is a front view in elevation of a push-up pad molded to position the malleable material higher in the cup.
Figure 6:
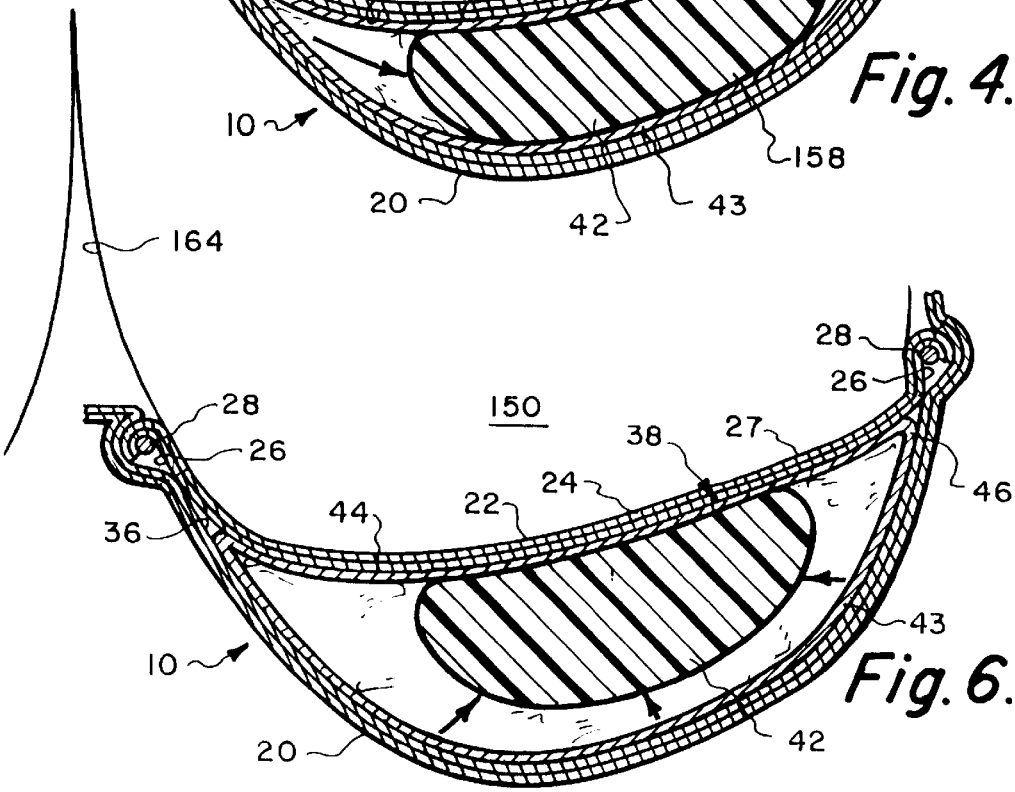
FIG. 6 is a view in section taken along line 6—6 of FIG. 5.

When the body 42 of the malleable material, as shown in FIGS. 5 and 6, is placed higher in the bra cup the cleavage 164 is still longer.

It is to be realized that only preferred embodiments of the invention have been described and that numerous substitutions, modifications and alterations are permissible without departing from the spirit and scope of the invention as defined in the following claims.

What is claimed is:

1. A push-up pad for a bra comprising a flexible, sealed envelope containing a body of lubricious, malleable material, said material having no elastic memory, being moldable into a plurality of shapes and being formed of a lightly, cross-linked synthetic, self-lubricating organo-polysiloxane resin containing 3–40% by weight of a finely divided reinforcing filler having a density of less then 1.0 immobilized within the cross-linked resin.

2. A pad according to claim 1 in which the organo-polysiloxane material is formed from cross-linkable liquid organo-polysiloxane resins.

3. A pad according to claim 2 in which the liquid resins contain cross-linking groups.

4. A pad according to claim 3 in which the groups are unsaturated groups capable of addition reaction.

5. A pad according to claim 4 in which the groups are vinyl groups.

6. A pad according to claim 1 in which the envelope is formed of a heat sealable, flexible, puncture-resistant, leak-resistant, film having a thickness from 0.01 to 5 mm.

7. A pad according to claim 1 further comprising two outer fabric layers joined at their peripheries forming a pocket which receives the envelope.

8. A pad according to claim 7 in which the inner surfaces of the fabric layers contain a layer of cushioning material.

9. A push-up bra cup comprising in combination;

a front panel in the shape of a bra cup and having a peripheral edge;

a rear panel in the shape of a bra cup having a peripheral edge;

the peripheral edges being joined to form a cavity; and a flexible pouch containing a body of lubricious, malleable material received in the cavity, said material having no elastic memory, being moldable into a plurality of shapes and being formed of a lightly, cross-linked synthetic, self-lubricating organo-polysiloxane resin containing 3–40% by weight of a finely divided reinforcing filler having a density of less then 1.0 immobilized within the cross-linked resin.

10. A push-up bra containing:

two bra cups;

means joining the cups;

a strap connecting the cups;

said cups containing a flexible pouch containing a body of lubricous, malleable material, said material having no elastic memory, being moldable into a plurality of shapes and being formed of a lightly, cross-linked synthetic, self-lubricating organo-polysiloxane resin containing 3–40% by weight of a finely divided reinforcing filler having a density of less then 1.0 immobilized within the cross-linked resin.

11. A push-up bra according to claim 10 in which the push-up bra forms the top of a bathing suit.

12. A bathing suit having a top portion including a pair of breast receiving cups, a push-up pad containing a body of malleable material having the consistency of breast tissue being present in each said cup, said material having no elastic memory, being moldable into a plurality of shapes and being formed of a lightly, cross-linked synthetic, self-lubricating organo-polysiloxane resin containing 3–40% by weight of a finely divided reinforcing filler having a density of less then 1.0 immobilized within the cross-linked resin.

13. A push-up bra pad for a bra comprising a flexible, sealed envelope containing a body of lubricious, malleable material comprising a cross-linked, self-lubricating, synthetic, organo-polysiloxane resin comprising a mixture of a major amount of a first diakly alkyl vinyl siloxane copolymer and a minor amount of a second alkyl vinyl dialkyl alkyl hydrogen siloxane copolymer where each alkyl contains from 1 to 6 carbon atoms.

14. A pad according to claim 13 in which the material is cross-linked to an extent of no more than 10%.

15. A pad according to claim 13 in which the first siloxane copolymer is a mixture of dimethyl and methyl vinyl siloxane and the second siloxane is a mixture of methyl vinyl and dimethyl methyl hydrogen siloxane.

16. A push-up pad for a bra comprising a flexible, sealed envelope containing a body of lubricious, malleable material formed of a lubricious, vinyl substituted, liquid organo-polysiloxane resin cross-linked by addition reaction containing from 3 to 40% of a finely divided reinforcing filler having a density of less then 1.0.

* * * * *